US008636086B2

(12) United States Patent
Hbaieb et al.

(10) Patent No.: US 8,636,086 B2
(45) Date of Patent: Jan. 28, 2014

(54) METHODS OF DRILLING WITH A DOWNHOLE DRILLING MACHINE

(75) Inventors: Slim Hbaieb, Paris (FR); Henri Denoix, Chatenay Malabry (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 290 days.

(21) Appl. No.: 12/742,462

(22) PCT Filed: Nov. 14, 2008

(86) PCT No.: PCT/EP2008/009636

§ 371 (c)(1), (2), (4) Date: Aug. 13, 2010

(87) PCT Pub. No.: WO2009/062725

PCT Pub. Date: May 22, 2009

(65) Prior Publication Data

US 2010/0314173 A1 Dec. 16, 2010

(30) Foreign Application Priority Data

Nov. 15, 2007 (GB) ..... 0722446.2

(51) Int. Cl.
*E21B 44/00* (2006.01)

(52) U.S. Cl.
USPC ..... 175/24; 175/51

(58) Field of Classification Search
USPC ..... 175/24, 26, 27, 51
See application file for complete search history.

(56) References Cited

U.S. PATENT DOCUMENTS

| | | | | |
|---|---|---|---|---|
| 2,369,550 | A * | 2/1945 | Frosch | 250/262 |
| 4,051,908 | A | 10/1977 | Driver | |
| 4,733,733 | A | 3/1988 | Bradley et al. | |
| 4,854,397 | A | 8/1989 | Warren et al. | |
| 5,368,108 | A | 11/1994 | Aldred et al. | |
| 5,679,894 | A | 10/1997 | Kruger et al. | |
| 5,842,149 | A * | 11/1998 | Harrell et al. | 702/9 |

(Continued)

FOREIGN PATENT DOCUMENTS

| | | |
|---|---|---|
| EP | 0401167 | 12/1990 |
| EP | 0911483 | 8/2006 |

(Continued)

OTHER PUBLICATIONS

IADC/SPE 47799, Lithology Diagnosis Based on the Measurements of Drilling Forces and Moments at the Bit; M. B. Ziaja, SPE, Montana Tech Montana U. and J.-C. Roegiers, SPE, Oklahoma U.

(Continued)

*Primary Examiner* — William P Neuder
*Assistant Examiner* — Ronald Runyan
(74) *Attorney, Agent, or Firm* — Stephanie Chi; Jody DeStefanis

(57) ABSTRACT

A drilling system and method are provided. The drilling system comprising a tool body, a drill bit, a mechanism for applying weight to the drill bit ("WOB"), and a control system for controlling the rate of rotation of the drill bit ("RPM") and the weight applied to the bit during drilling. The control system is configurable to a first mode in which RPM and WOB are controlled to maintain power on the drill bit at a predetermined maximum, and a second mode in which RPM and WOB are controlled to maintain a predetermined depth of cut ("DOC"). In use, the control system is adapted to switch between the first and second modes depending on drilling conditions.

2 Claims, 2 Drawing Sheets

(56) References Cited

U.S. PATENT DOCUMENTS

| | | | | |
|---|---|---|---|---|
| 6,142,235 | A | 11/2000 | Monjure et al. | |
| 6,305,469 | B1 | 10/2001 | Coenen et al. | |
| 6,467,557 | B1 | 10/2002 | Krueger et al. | |
| 6,490,527 | B1 | 12/2002 | Utt | |
| 6,629,568 | B2 | 10/2003 | Post et al. | |
| 6,629,570 | B1 | 10/2003 | Head | |
| 6,732,052 | B2 | 5/2004 | Macdonald et al. | |
| 2003/0075361 | A1 * | 4/2003 | Terry et al. | 175/61 |
| 2003/0187582 | A1 | 10/2003 | Goldman et al. | |
| 2005/0252688 | A1 | 11/2005 | Head et al. | |
| 2007/0056772 | A1 | 3/2007 | Koederitz et al. | |

FOREIGN PATENT DOCUMENTS

| | | |
|---|---|---|
| EP | 0877148 | 4/2007 |
| EP | 1780372 A1 * | 5/2007 |
| EP | 1640556 | 6/2008 |
| EP | 1780372 | 12/2009 |
| GB | 2388132 | 11/2003 |
| WO | 9312318 | 6/1993 |
| WO | 98/16712 | 4/1998 |
| WO | 1998/016712 | 4/1998 |
| WO | 2004011766 | 2/2004 |
| WO | 2004/072437 | 8/2004 |
| WO | 2004083595 | 9/2004 |
| WO | 2005028805 | 3/2005 |

OTHER PUBLICATIONS

SPE 60750 Anaconda: Joint Development Project Leads to Digitally Controlled Composite Coiled Tubing Drilling System; Roy Marker, John Haukvik, Statoil; James B. Terry, Martin D. Paulk, E. Alan Coats, Tom Wilson, Jim Estep, Mark Farabee, Scott A. Berning, Haoshi Song, Halliburton Energy Services, Inc.

* cited by examiner

METHODS OF DRILLING WITH A DOWNHOLE DRILLING MACHINE

CROSS-REFERENCE TO RELATED APPLICATIONS

The present application is based on and claims priority to GB Application No. 0722446.2, filed 15 Nov. 2007; and International Patent Application No. PCT/EP2008/009636, filed 14 Nov. 2008. The entire contents of each are herein incorporated by reference.

TECHNICAL FIELD

This invention relates to techniques for drilling boreholes. In particular it relates to such techniques that are useful for drilling boreholes using a wireline drilling machine.

BACKGROUND ART

Conventional drilling can be performed with Coil Tubing (CTD) or with Jointed Pipes (JPD). CTD can be described as drilling with a continuous pipe coiled onto a reel. It is associated with a downhole drilling motor that provides rotation to the bit. JPD uses jointed drill pipes which can either be rotated from surface or have a downhole drilling motor to rotate the bit.

In both CTD and JPD techniques, the drillstring (CT or pipes) provides the weight on bit (WOB) transfer from surface to downhole. Downhole drilling efficiency is therefore dependant on the full drillstring transfer function (frictional losses, drag effect, vibrations . . . ). Various surface and downhole sensors collect data and send them to a surface processor for monitoring. Drilling and steering commands are then applied from surface.

Various proposals have been made to address a market need such as extended reach or short radius drilling, in which the bottom hole assembly is designed to perform new functions such as generating the weight and the torque on bit downhole, while the drill string and surface rig functionality are reduced. No mechanical power transmission from surface to downhole is used, thereby reducing drilling efficiency losses due to the drill string transfer function. The power can be conveyed from surface to downhole via an electrical or hydraulic link (wireline, wired drill pipes, hydraulic pump at surface with downhole turbine, etc.). The electrical power is then converted downhole into mechanical power at the bit via an electrical drilling motor and a thruster to generate the WOB.

The methods and systems used for monitoring drilling and steering currently proposed for electrical drilling are usually the same used for conventional drilling. They have not yet taken the advantages presented by the electrical drilling machines and are currently derived from various characteristics inherent only to CTD and JPD, for example:

- The drilling process is controlled from surface in order to drill a borehole and control its direction.
- Various sensors and actuators are at surface, for example WOB is controlled from surface.
- The drillstring mechanical motion and its interface with the wellbore and casing string is a major contributor to the drilling dynamics.
- The mechanical power injected at surface is very high.
- It is not possible to measure precisely the depth and ROP of the drill bit due to the drill pipe and coil tuning flexion under the WOB.

- It is not possible to control the instantaneous ROP of the bit. Control is done by applying a constant WOB at surface and monitoring the TOB and ROP.
- The two-way telemetry from surface to downhole has a limited bandwidth.
- The BHA design changes from one well to another.
- Downhole drilling parameters WOB, TOB and RPM are impacted by many factors such as the length of the drillstring, well profile, rock bit interaction, tubing/borehole frictions, BHA layout.
- The drilling strategy is based on a surface WOB control with a fixed bit RPM. Obtained ROP depends on the formation strengths and lithology encountered.

The drilling commands of WOB, RPM are set at surface in all conventional drilling systems. Many systems propose using surface models to predict the drilling behavior and therefore assist the driller optimize the drilling and steering process. These have as inputs data from downhole sensors sent via a telemetry system as well as surface sensor parameters. Examples can be found in U.S. Pat. Nos. 6,732,052, 4,733,733, and 4,854,397.

Other systems in conventional drilling allow dynamically adjustment of the surface parameters in order to maximize the drilling efficiency, for example many rigs have a dynamic control of RPM or torque on a top drive in order to attenuate the torsional vibrations of the drill string. Other mechanisms have been developed to be included in the BHA and that either passively or actively try to attenuate torque, WOB or RPM fluctuations.

With regard to current directional drilling techniques, all existing techniques rely on two way communication from surface. One limitation of full automating the steering downhole in conventional drilling is that the information of bit depth is measured at surface. Also the directional behavior of the hole will depend on many factors such as WOB, and drillstring behavior. Examples can be found in U.S. Pat. No. 6,467,557, WO 2005/028805, and WO 93/12318. U.S. Pat. No. 6,490,527 discloses a method and system for determining the relative strength and classification of rock strata using neural networks applied on conventional drilling. One of the limitations of the technique is that the data collected by the sensors to calculate the specific energy of the rock are not only representative of the formation but also account partly for the behavior of the drillstring. Also, phenomena such as bit balling can not be detected properly in real time such that subsequent drilling data may be wrongly interpreted. Some studies have been developed to solve some of these limitation but the techniques stay limited due to the high number of uncertainty (see IADC/SPE 47799).

While there have been various proposals for electrical drilling machines, none of them present methods of drilling that takes advantage of the fact that all actuators and sensors relative to drilling are located downhole. Examples of the existing techniques include U.S. Pat. Nos. 4,051,908, 6,305,469, US-2005-0252688, WO 20041083595, EP0911483, SPE 60750, U.S. Pat. No. 6,467,557, WO 2004/011766, U.S. Pat. Nos. 6,142,235, 6,629,570. GB2388132, and U.S. Pat. No. 6,629,568.

All of the existing techniques rely on a WOB or ROP control at surface to optimize the drilling process. At a given ROP, many depths of cut are possible depending on bit RPM. Having a constant DOC is not equivalent to having a constant ROP. DOC can be limited in conventional drilling by bit design. However, DOC cannot be controlled by the drilling process because of BHA dynamics and the lack of a precise DOC measurement precision. EP1780372 discloses a method of drilling using DOC as a controlled parameter. However, controlling DOC is not always the best way to optimize a drilling process. The present invention is intended to address this fact.

DISCLOSURE OF THE INVENTION

A first aspect of the invention provides a drilling system comprising:

- a tool body including a drilling motor;
- a drill bit mounted on the tool body to be rotated by the drilling motor;
- a mechanism for applying weight to the bit when drilling; and
- a control system for controlling the rate of rotation of the bit RPM and the weight applied to the bit WOB during drilling;
- wherein the control system is configurable to a first mode in which RPM and WOB are controlled to maintain the power on bit at a predetermined maximum; or a second mode in which RPM and WOB are controlled to maintain a predetermined depth of cut DOC; and in use, the control system switches between the first and second modes depending on drilling conditions.

The system preferably includes sensors for measuring RPM, ROP, WOB and the torque on bit TOB. Other sensors that can be provided include sensors for measuring vibrations. in the system, inclination and azimuth of the drilling system, and gamma ray count from the formation being drilled.

The drilling system typically comprises a flow passage through which drilling fluid can pass so that circulation of fluid between the borehole and the interior of the drilling system can take place. In this case, it is preferred to provide pressure sensors for measuring fluid pressure in the borehole and in the flow passage. The drilling fluid can be flowing from the flow passage to the borehole through the bit, or in the opposite direction.

Some or all of the sensors preferably operate at high frequency to acquire data.

A flexible conduit such as a cable and or tubing can be used to support the tool body in use and to provide power, data and/or fluids.

A second aspect of the invention provides a method of operating a drilling system according to the first aspect of the invention, comprising:

- positioning the drilling system in a borehole to be drilled;
- operating the drilling motor and mechanism for applying WOB to cause the drill bit to drill ahead; and
- using the control system to switch between first and second modes depending on drilling conditions.

The control system preferably includes control loops operating embedded in the tool body or between a surface system and the tool body.

The control system can be used to control the trajectory of the borehole drilled by the system.

Where the drilling system has a flow passage through which drilling fluid can pass, the method can comprise measuring fluid pressure in the borehole and in the flow passage. These measurements can be used to detect bit balling, flow passage plugging, or bad borehole cleaning. A closed loop at surface or downhole can be implemented to react and change the drilling parameters such as increasing the bit RPM, decreasing DOC, decreasing ROP, and/or decreasing WOB in order to optimise drilling efficiency.

MODE(S) FOR CARRYING OUT THE INVENTION

The invention is based on control of the drilling process that includes controlling the penetration per bit revolution (Depth of Cut control). Because the depth of cut reflects the size of the cuttings produced, such control can be used to create relatively small cuttings at all times (smaller than in conventional drilling), whose transport over a long distance requires much less power.

The drilling operation is performed by applying controlled weight to the drill bit (WOB) that is rotated to provide RPM to the bit, resulting in penetration into the formation (ROP). The torque and RPM encountered at the drill bit (TOB) is a product of the resistance of the formation and the torsional stiffness of the drilling system to the rotary drilling action of the drill bit. In effect, the actively (but indirectly) controlled parameters are WOB and RPM. TOB and ROP are products of this control.

The drilling system according to the invention differs in that it can be operated in one mode to control the length drilled per bit revolution (also called "depth of cut" or DOC), for example by measuring, at each instant, the penetration into the formation (ROP) and the bit rotation speed (RPM); and in another mode to optimise the power on bit irrespective of depth of cut.

A drilling system suitable for implementing the invention can comprise the following elements:

- A drilling motor capable of delivering the torque on bit (TOB) and the actual bit RPM with a predetermined level of accuracy and control.
- A tractor device capable of pushing the bit forward with a predetermined accuracy in instantaneous rate of penetration (ROP). The tractor can also help pulling or pushing the coiled tubing downhole.
- Electronics and sensors to allow control of the drilling parameters (TOB,
- DOC, RPM, ROP, etc.).
- Surface or downhole software for optimizing the drilling process.

Figure 1:
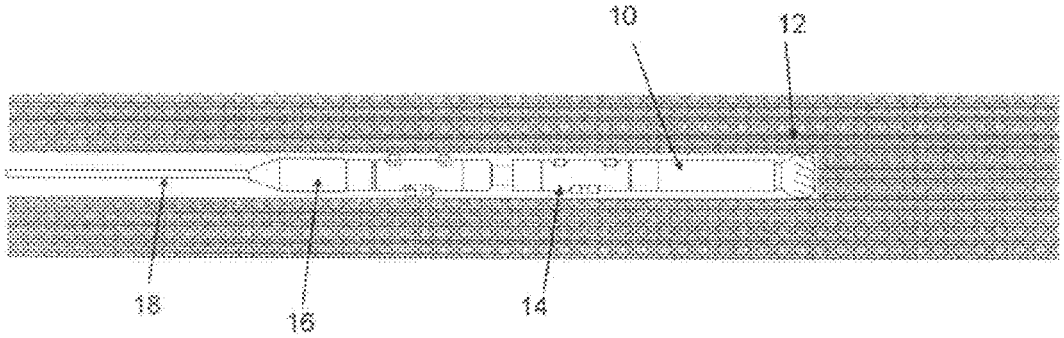
FIG. 1 shows a drilling system for implementing an embodiment of the invention.

A drilling system according to an embodiment of the invention for drilling boreholes in underground formations is shown in FIG. 1. The system includes a downhole drilling unit comprising a rotary drive system 10 carrying a drill bit 12. An axial drive system 14 is positioned behind the rotary drive system 10 and connected to the surface a control section 16 and coiled tubing 18 carrying an electric cable (not shown).

The rotary drive system 10 includes an electric motor but which the drill bit 12 is rotated.

In use, the drilling system is run into the borehole 20 until the bit 12 is at the bottom. Drilling proceeds by rotation of the bit 12 using the rotary drive system 10 and advancing the hit into the formation by use of the axial drive system 16. Control of both is effected by the control system 16 which can in turn be controlled from the surface or can run effectively independently.

By generating axial effort downhole by use of the tractor 14, and by generating relatively small cuttings, the size of the coiled tubing 18 used can be smaller than with previous CTD systems. Because the coiled tubing is not required to generate weight on bit, the basic functions to be performed by the coiled tubing string are limited to:

Acting as a flowline to convey the drilling fluid downhole;

Acting as a retrieval line to get the bottom hole assembly out of hole, especially when stuck; and Helping to run in hole with its pushing capacity.

The axial drive system is preferably a push-pull tractor system such as is described in PCT/EP04/01167. The tractor 14 has a number of features that allow it to operate in a drilling environment, including:

The ability to function in a flow of cuttings-laden drilling fluid and to be constructed so that cuttings do not unduly interfere with operation;

The ability to operate in open hole;

Accurate control of ROP with precise control of position and speed of the displacement.

Accurate measurement of weight on bit

The presence of a flow conduit for drilling fluid circulation in use.

Certain features can be optimised for efficient tripping, such as a fast tractoring speed (speed of moving the downhole unit through the well), and the capabilities of crawling inside casing or tubing. In order for the tractor to be useful for re-entry drilling, it needs the ability to cross a window in the casing and to be compatible with a whipstock.

In one preferred embodiment, the tractor uses the push-pull principle. This allows dissociation of coiled tubing pulling and drilling, which helps accurate control of the weight on bit. A suitable form of tractor is described in European patent application no. 04292251.8 and PCT/EP04/01167. In another embodiment, the tractor is a continuous system, with wheels or chains or any other driving mechanism.

The motor 10 is provided with power by means of an electric cable which also provides a medium for a two-way high-speed telemetry between surface and downhole systems, thus enabling a better control of downhole parameters. Intelligent monitoring of downhole parameters, such as instantaneous torque on bit, can help avoid or minimize conventional drilling problems such as stick-slip motion, bit balling, bit whirling, bit bouncing, etc.

An electric cable can be deployed along with the coiled tubing. This can be achieved in various configurations, including:

the electric cable is pumped inside coiled tubing;

the electric cable is clamped on the outside of the coiled tubing; or the coiled tubing is constructed with electric wires in its structure.

However, in a different embodiment, the downhole drilling assembly can be hydraulically powered. The downhole drilling system can be hydraulically powered and equipped with a downhole alternator to provide electric power to tool components. In this configuration, there is no need for electric lines from the surface.

The control system 16 provides power and control to the axial and rotary drive systems 10, 14. It comprises sensors to measure key drilling and steering parameters (such as instantaneous penetration rate, torque on bit, bit RPM, etc.) and can be split in several modules.

Figure 2:
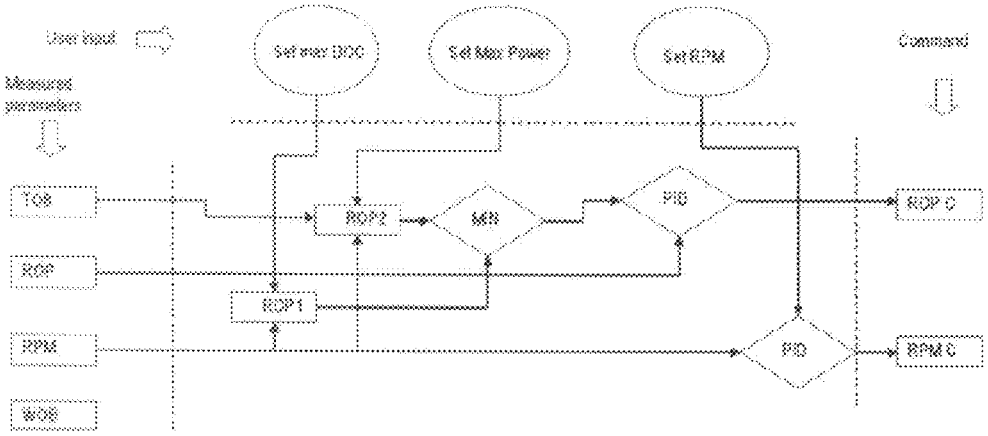
FIG. 2 shows a control system for use in the drilling system of FIG. 1.

FIG. 2 shows the functional structure of one embodiment of a control system. The drilling system shown in FIG. 2 has various drilling parameters that are measured during operation. These include TOB, ROP. RPM and WOB. There are also controlled parameters including DOC (also considered as cuttings size and/or ROP, maximum set by user depending on cuttings transport environment, drilling fluid type, etc.), power (set by user depending on temperature environment, rock type, hardware limitations, etc.) and RPM (set by user dependent on environment, vibrations, etc.). The outputs of the control system are commands controlling ROP and RPM.

When operating in the mode to control DOC, the operator sets max DOC, max power and RPM and drilling commences. During drilling, measurements are made of the drilling parameters listed above. A first calculated value ROP1 is obtained from the measured RPM and the set DOC. A second calculated values ROP2 is obtained from the measured RPM, TOB and the set max power. The lower of ROP1 and ROP2 is selected and PID processed with regard to the measured ROP to provide a command signal ROP C that is used to control ROP of the drilling system.

The measured and set RPM are PID processed to provide a command signal RPM C that is used to control the RPM of the system.

WOB is measured but not used in any of the control processes or actively controlled. In the context of this invention, WOB is a product of the drilling process rather than one of the main controlling parameters.

Similar steps (mutatis mutandis) can be taken when operating in the maximum power mode.

The present invention provides a system for efficiently directional drilling a wellbore with an electrical drilling machine where no mechanical power is transmitted from surface to downhole by means of the drillstring. The downhole unit is then isolated from torque and axial force generated when drilling through the formation. The system has high frequency sampling sensors of drilling and steering parameters (bit RPM, bit torque TOB, bit axial load WOB, inclination, azimuth, gamma ray, etc.).

The system can use embedded and/or surface closed loop control loops to efficiently drill a borehole in an underground formation and follow a well plan trajectory.

Vibrations of the tool can be directly measured and controlled with mean of high frequency downhole servo-loops, and actuators and drilling/steering parameters. Drilling and steering data such as WOB, TOB, DOC, and azimuthal orientation, are sensed and processed by downhole processors. Necessary adjustments are then calculated by downhole processors and applied to appropriate actuators to optimize the drilling efficiency process.

The system is able to switch between different closed loop strategies to optimize drilling efficiency.

By means of controlling the Power On Bit and maintaining it at a maximum value. the system allows to continuously adapt the drilling parameters to the formation changes to have the maximum ROP within the available power budget.

By means of controlling the Depth Of Cut, the system limits the size of the cuttings generated by the drill bit. The system measures instantaneous bit RPM and ROP and calculates the DOC. It can then adjust either bit RPM or WOB to achieve the desired DOC as is described above. Various numerical algorithms can be applied such as neural networks, fuzzy logic, predictive control, adaptive controls, etc. Controlling DOC is different from controlling ROP. Indeed, at a given ROP, different DOC can be provided by varying the bit RPM. By controlling DOC, the size distribution of the cuttings can be controlled. The smaller cuttings are, the less hydraulic power is needed to transport them and clean the hole. Controlling the DOC will enable the use of a low power downhole pump for cuttings removal. Ability to control DOC is enabled by the tractor and the downhole drilling motor. There are no load or rotational motion transfers from surface. The sensors and closed loops are all embedded in the downhole software allowing a very quick and accurate control with no delay due to telemetry to surface or across the downhole turbines.

Figure 3:
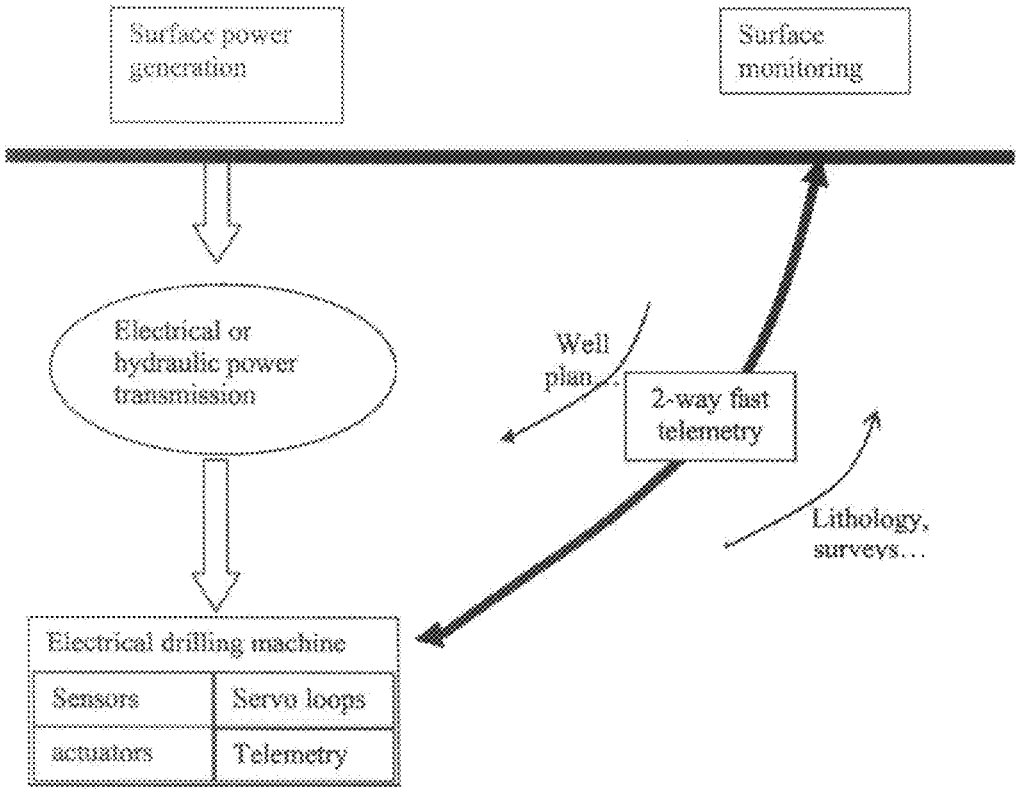
FIG. 3 shows the various control and operational steps for a system in use.

To allow easy and accurate detection of bit balling, two pressure sensors can be placed close to the bit (one to detect pressure in the annulus around the tool, and one inside the BHA or tubing inside the tool). A high frequency data analysis of the pressure drop across the bit allows downhole detection of bit balling, bit plugging or hole cleaning issues. Automated corrective action can be made by the system to follow a specific operating sequence and remedy the problem and/or to change the drilling parameters. The high frequency acquisition of drilling data such as (DOC, TOB, WOB, RPM, vibration, pressure drop across the bit, etc.) allows the identification of lithology and rock structure and stratigraphy through downhole modeling (neural networks, fuzzy logics . . . ). The drilling parameters and the well plan can be changed via an active closed loop to adjust to changes in lithology. FIG. 3 summarises the major control and measurement steps of the method.

The high speed telemetry enables a trajectory control in closed loop which can be implemented either at surface or downhole. The closed loop constantly monitors the well plan coordinates and compares it to the current well trajectory. It then modifies the steering mechanism settings to reduce the error or to adapt the well plan. The closed loop operates at very high frequency, for example updating the drilling after each foot of hole drilled. This allows reduction of well tortuosity.

Other changes within the scope of the invention will be apparent.

What is claimed is:

1. A method of operating a drilling system, comprising:

positioning the drilling system at a wellsite for drilling a borehole into an underground formation, the drilling system comprising:

a tool body including a drilling motor;

a drill bit mounted on the tool body to be rotated by the drilling motor;

a mechanism for applying weight to the drill bit ("WOB") during drilling; and a control system for controlling the rate of rotation of the drill bit ("RPM") and the weight applied to the drill bit during drilling;

wherein the control system is configurable to a first mode in which RPM and WOB are controlled to maintain power on the drill bit at a predetermined maximum; and wherein the control system is configurable to a second mode in which RPM and WOB are controlled to maintain a predetermined depth of cut ("DOC");

operating the drilling motor and mechanism for applying WOB to cause the drill bit to drill ahead; and using the control system to switch between the first mode and second mode depending on drilling conditions, wherein high frequency acquisition of drilling data allows identification of lithology and rock structure and stratigraphy through the use of downhole modeling, wherein the modeling comprises the use of neural networks and/or fuzzy logic.

2. A method of operating a drilling system comprising a flow passage through which drilling fluid can pass, wherein the method comprises:

positioning the drilling system at a wellsite for drilling a borehole into an underground formation, the drilling system comprising:

a tool body including a drilling motor;

a drill bit mounted on the tool body to be rotated by the drilling motor;

a mechanism for applying weight to the drill bit ("WOB") during drilling; and a control system for controlling the rate of rotation of the drill bit ("RPM") and the weight applied to the drill bit during drilling;

wherein the control system is configurable to a first mode in which RPM and WOB are controlled to maintain power on the drill bit at a predetermined maximum; and wherein the control system is configurable to a second mode in which RPM and WOB are controlled to maintain a predetermined depth of cut ("DOC");

operating the drilling motor and mechanism for applying WOB to cause the drill bit to drill ahead;

measuring fluid pressure in the borehole and in the flow passage, wherein the pressure measurements are used to detect at least one of bit balling, bit plugging, and hole cleaning issues automatically correcting a problem following a specific operating sequence by changing at least one of a plurality of drilling parameters; and using the control system to switch between the first mode and second mode depending on drilling conditions, wherein the at least one of the plurality of drilling parameters and a well plan are changed via an active closed loop to accommodate changes in lithology.

* * * * *